US005335604A

United States Patent [19]

Jiang

[11] Patent Number: 5,335,604

[45] Date of Patent: Aug. 9, 1994

[54] FOLDING TABLE

[75] Inventor: Wei X. Jiang, PanYu City, China

[73] Assignee: Selby Furniture Hardware Company, Inc., Bronx, N.Y.

[21] Appl. No.: 991,858

[22] Filed: Dec. 15, 1992

[51] Int. Cl.[5] ..... A47B 3/02

[52] U.S. Cl. ..... 100/119; 108/118

[58] Field of Search ..... 108/118, 119, 115, 131, 108/124; 248/432, 164, 431

[56] References Cited

U.S. PATENT DOCUMENTS

| | | | |
|---|---|---|---|
| D. 149,619 | 5/1948 | Dahm . | |
| 413,324 | 10/1889 | Ketchum | 108/118 |
| 610,269 | 9/1898 | Hodgkins | 108/119 |
| 1,165,382 | 12/1915 | Anderson . | |
| 1,295,073 | 2/1919 | Schwartz | 108/119 |
| 1,942,203 | 1/1934 | Johanson . | |
| 2,060,367 | 11/1936 | Flagstad . | |
| 2,587,010 | 2/1952 | Thompson | 108/118 X |
| 2,601,357 | 6/1952 | Allbritton . | |
| 3,080,202 | 3/1963 | Franzene | 108/119 X |
| 3,385,959 | 10/1967 | Linstead | 108/119 |
| 3,646,895 | 3/1972 | Campbell . | |
| 4,592,287 | 6/1986 | Thygeson | 108/118 X |
| 4,686,910 | 8/1987 | Skjerseth | 108/118 X |
| 4,714,224 | 12/1987 | Calmes . | |

FOREIGN PATENT DOCUMENTS

| | | | |
|---|---|---|---|
| 268660 | 2/1965 | Australia | 108/118 |

*Primary Examiner*—Jose V. Chen

*Attorney, Agent, or Firm*—Malina & Wolson

[57] ABSTRACT

A folding table is described with a tablet and supporting frame. The frame includes an outer and inner pair of legs as well as a U-shaped link bar. The outer legs are directly attached by a connector to the underside of the tablet. The inner legs are pivotally joined to the outer ones and further are pivotally joined to the U-shaped link bar. In turn, free ends of the link bar are pivotally attached to the underside of the tablet through an L-shaped bracket. A stop device in the form of a brace with leg extending orthogonally outward is attached onto the link bar to brace the latter against the inner legs when the table is in the open upright position. Each of the legs have upper and lower portions, these portions being bent at an obtuse angle relative to one another. When the table is completely folded, the upper portions of the legs are oriented parallel to one another while the lower ones are oriented away from one another.

7 Claims, 2 Drawing Sheets

FIG. 2
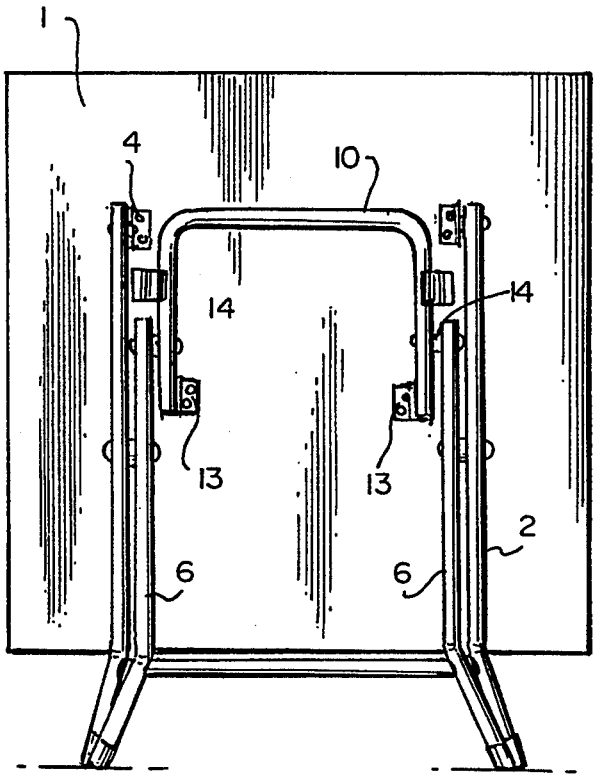
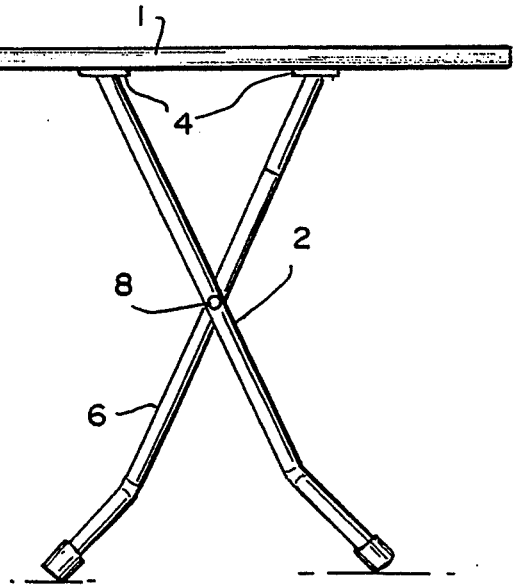
FIG. 1
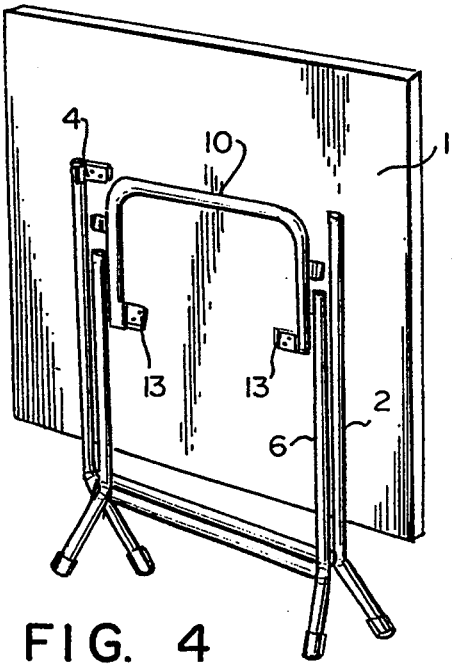
FIG. 4
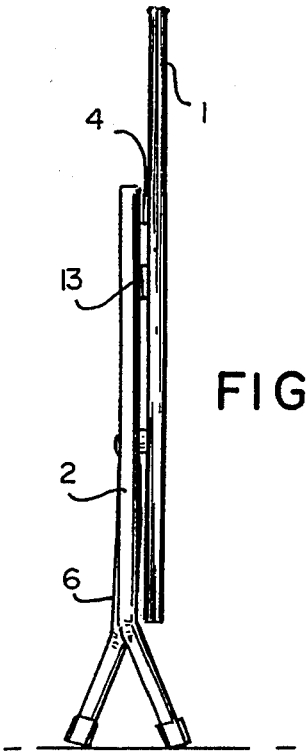
FIG. 3

FOLDING TABLE

BACKGROUND OF THE INVENTION

1. Field of the Invention

The invention concerns a cross-legged table foldable for storage purposes into a compact form.

2. The Related Art

The history of foldable or collapsible tables is a long one. For instance, U.S. Pat. No. 413,324 (Ketchum) describes a foldable table having two pairs of cross-legs hinged to a table-top. The innermost pair of legs consist of two parts, each pivotally joined with one another. The upper part is hinged to the table-top at one end while the other end has a concave construction. The lower part of the inner legs is bridged by a round bar over which engages the concave end of the upper part. One of the disadvantages of this arrangement is that in the folded position the table is not free-standing. Furthermore, the round bar is situated at half-height of the table thereby potentially interfering with a person's legs beneath the table-top.

A full leg clearance has been achieved in an arrangement described in U.S. Pat. No. 3,646,895 (Campbell). Other than a lateral cross brace near the top, the table legs are free of any interfering bars. Heavy reliance is placed upon a stop bracket fastened to an upper leg portion. In the '895 patent, advantages of clearance have, however, been obtained at the expense of stability.

A sturdier construction is disclosed in U.S. Pat. No. 1,942,203 (Johanson) featuring a U-shaped link with bent arms through which the table-top pivots. Each of the crossed legs flare outwardly to improve stability.

Related art may also be found in U.S. Pat. No. 149,619 (Dahm), U.S. Pat. No. 1,165,382 (Anderson), U.S. Pat. No. 2,060,367 (Flagstad), U.S. Pat. No. 2,601,357 (Allbritton), and U.S. Pat. No. 4,714,224 (Calmes). Much of this art provides complicated engineering solutions to the problem of folding trays and tables.

Accordingly, it is an object of the present invention to provide a folding table which is of sturdy but simple and lightweight construction and that may be interconverted from an open upright to a closed-folded position.

Another object of the present invention is to provide a folding table in accordance with the foregoing object which is vertically free standing in the closed-folded position and nests in the horizontal stacking position.

It is a further object of the present invention to provide a folding table in accordance with the foregoing objects which may be simply and economically manufactured.

It is yet another object of the present invention to provide a folding table in accordance with the foregoing objects in which the legs and cross-members of the folding support structures for the tablet thereof comprises formed metal tubing, thereby facilitating simple and economical manufacture.

It is yet a further object of the present invention to provide a folding table having sufficient clearance below the table top for a person's legs to be comfortably accommodated.

SUMMARY OF THE INVENTION

A folding table is provided including:

a tablet having a top and bottom surface;

a pair of first legs each having an upper and lower end;

a first pair of connectors each for pivotally connecting one of the respective first upper leg ends to the bottom surface of the tablet;

a pair of second legs each having an upper and lower end and positioned inwardly between the pair of first legs;

a pair of pivot structures each for pivotally joining one of the respective first and second legs so that these legs can extend diagonally underneath the tablet when the table is unfolded to an upright position;

a U-shaped link bar formed with two parallel members and a cross member, the bar having first and second free ends;

a pair of further connectors each for pivotally connecting one of the respective link bar free ends to the bottom surface of the tablet;

a pair of further pivot structures each for pivotally joining the link bar through the respective one of the parallel members to a respective one of the second legs at the upper end thereof, the link bar being positioned inwardly between the pair of second legs;

a stop device positioned between the further pivot structure and cross member to brace the link bar and second legs together when the table is in the upright position.

Advantageously, the stop device is formed on the U-shaped link bar. Preferably this device is a brace with a leg extending orthogonally outward from the parallel member of the link bar.

Each of the further pair of connectors is preferably an L-shaped bracket having a horizontal and vertical arm, the horizontal arm being attached to the bottom surface of the tablet. Moreover, the further pair of connectors each includes a further pivot structure connecting a respective one of the free ends of the link bar with a respective one of the vertical arms.

In a preferred embodiment, the first and second pair of legs each are unitarily formed. These legs include an upper and lower portion, these portions being bent at an obtuse angle relative to one another. When in a completely folded position of the table, the upper portions of the first and second pair of legs are oriented parallel to one another; while, the lower portions of the first and second pairs of legs are oriented away from one another.

A transverse bar is preferably present to join together the first pair of legs. Joinder of the legs is at the vertex of the obtuse angle. A further transverse bar can be provided to join together the second pair of legs. Again, joinder of the legs is at the vertex of the obtuse angle.

BRIEF DESCRIPTION OF THE DRAWING

The above features, advantages and objects of the present invention will more fully be appreciated through the following detailed discussion, reference being made to the drawing consisting of:

FIG. 1 which is a side elevational view of a preferred embodiment of the folding table in an open upright position according to the present invention;

FIG. 2 which is a front elevational view showing the underside of the table of FIG. 1 except in the folded position;

FIG. 3 which is a side elevational view of the table according to FIG. 1 except being in the folded position;

FIG. 4 which is a perspective view of the table as shown in FIG. 2 and FIG. 3;

DETAILED DESCRIPTION

Figure 5:
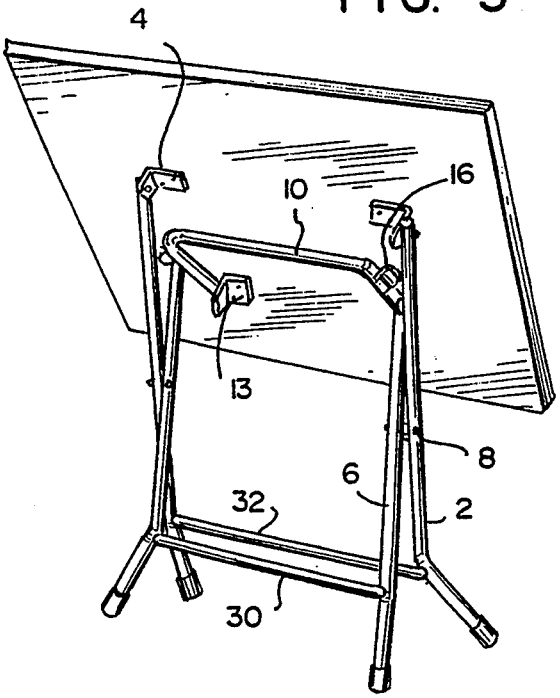
FIG. 5 which is a perspective plan view of the table in the partially collapsed position intermediate the positions shown in FIG. 1 and FIG. 4.

FIG. 1 illustrates a table in the full open upright position. The table includes a tablet 1 supported by a frame stand. This stand includes a pair of outer legs 2, a pair of inner legs 6 and a U-shaped link bar 10. The pair of outer legs 2 have an upper and lower end. A pair of connectors 4 each pivotally connect one of the respective first upper leg ends to the bottom surface of the tablet 1. Inner legs 6 each have an upper and lower end; these inner legs are positioned inwardly between the pair of outer legs 2.

A pair of pivot structures 8 each pivotally join one of the respective outer and inner legs 2, 6 so that these legs can extend diagonally beneath the tablet 1 when the table is unfolded to its upright position.

Figure 6:
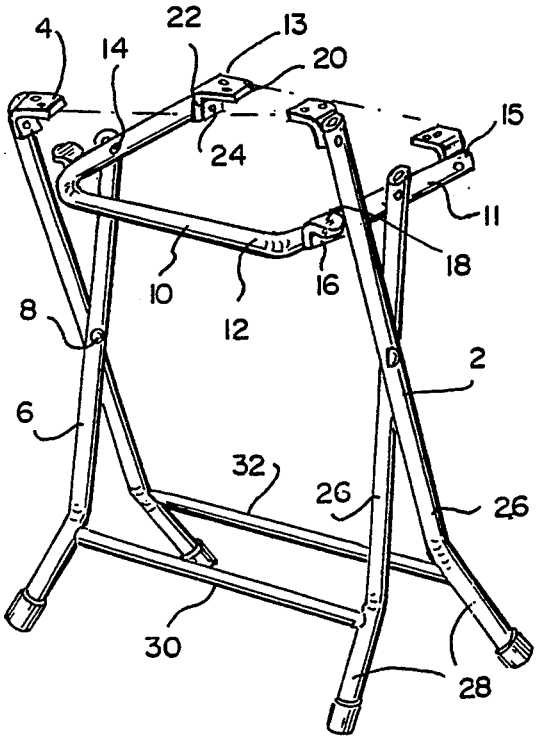
FIG. 6 which is a perspective plan view of various structural features according to FIG. 1 except with tablet removed.

FIG. 5 and 6 best illustrate the U-shaped link bar 10. This bar is formed with two parallel members 11 and a cross-member 12. The bar has a pair of free ends 15.

A pair of further connectors 13 each pivotally connect one of the respective link bar free ends 15 to the bottom surface of the tablet 1. A pair of further pivot structures 14 pivotally join the link bar 10 through a respective one of the parallel members 11 to a respective one of the inner legs 6 at the upper end thereof. The link bar 10 is positioned inwardly between the pair of inner legs 6.

A stop device in the form of brace 16 is best illustrated in FIG. 6. The brace has a leg 18 extending orthogonally outward from parallel member 11.

Connectors 13 are each in the form of an L-shaped bracket having a horizontal and vertical arm. The horizontal arm is attached to the bottom surface of the tablet 1. A further pivot member 24 connects a respective one of the free ends 15 of the link bar 10 with a respective one of the vertical arms 22.

Advantageously, the outer and inner legs 2, 6 each are unitarily formed. They include an upper portion 26 and lower portion 28. These portions are bent at an obtuse angle relative to one another. When the table is completely in the folded position, the upper portion 26 of the outer and inner pair of legs 2, 6 are oriented parallel to one another; while, the lower portions 28 of the outer and inner legs 2, 6 are oriented away from one another. This arrangement is best seen in FIGS. 1, 3, 4 and 6.

Additionally, there will be present a transverse bar 30 joining together the inner pair of legs 6. Joinder of these legs is at the vertex of the obtuse angle Similarly, there is a further transverse bar 32 joining together the outer pair of legs 2. Here, joinder of the legs is also at the vertex of the obtuse angle.

A series of folding tables when in the folded position can be nested together in either a horizontal or vertical stack. Nesting is accommodated by the symmetrical arrangement of the frame components.

Figure 7:
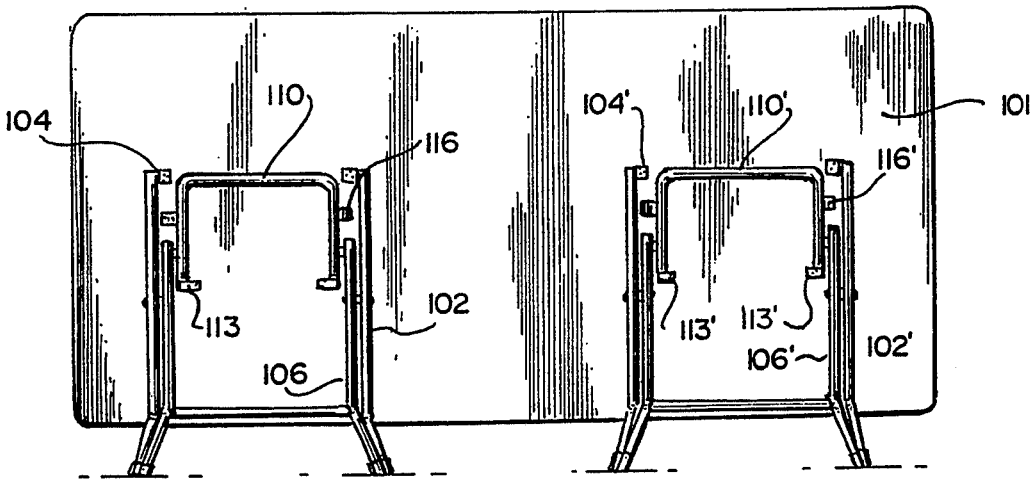
FIG. 7 which is a conference table utilizing a set of support structures, each according to that shown in FIG. 6.

FIG. 7 illustrates a further embodiment of the invention demonstrating application of the frame to a conference-type table. The tablet 101 is supported by a pair of identical frames. Each of these frames includes an outer leg pair 102, 102', an inner leg pair 106, 106', and U-shaped link bars 110, 110'. The outer and inner leg pairs are joined together by the connectors 104, 104'. A further set of connectors 113, 113' join the U-shaped link bars 110, 110' to the underside of tablet 101. A stop device which is brace 116, 116' is present to function as a brace between the link bar and the inner legs.

The foregoing description illustrates only preferred embodiments of the invention. The concepts employed may, based upon the description, be employed in other embodiments without departing from the spirit and purview of the invention. Accordingly, the following claims are intended to protect the invention broadly, as well as in the specific forms shown herein.

What is claimed is:

1. A folding table comprising:

a tablet having a top and bottom surface;

a pair of first legs each having an upper and lower end;

a first pair of connector means each for pivotally connecting one of the respective first upper leg ends to the bottom surface of the tablet;

a pair of second legs each having an upper and lower end, and positioned inwardly between the pair of first legs;

a pair of pivot means each for pivotally joining one of the respective first and second legs so that these legs can extend diagonally underneath the tablet when the table is unfolded to an upright position;

a U-shaped link bar formed with two parallel members and cross member, the bar having first and second free ends;

a pair of further connector means each for pivotally connecting one of the respective link bar free ends to the bottom surface of the tablet;

a pair of further pivot means each for pivotally joining the link bar through a respective one of the parallel members to a respective one of the second legs at the upper end thereof, the link bar being positioned inwardly between the pair of second legs; and a stop means positioned between the further pivot means and cross member to stop movement of the link bar relative to the second legs when the table is in the upright position, said stop means being formed on the U-shaped link bar and being a brace having a leg extending orthogonally outward from the parallel member.

2. A folding table according to claim 1 wherein the further pair of connector means is each an L-shaped bracket having a horizontal and vertical arm, the horizontal arm being attached to the bottom surface of the tablet.

3. A folding table according to claim 2 wherein the further pair of connector means each comprises a further pivot member connecting a respective one of the free ends of the link bar with a respective one of the vertical arms.

4. A folding table according to claim 1 wherein the first and second pair of legs each are unitarily formed and comprise an upper and lower portion, the portions being bent at an obtuse angle relative to one another.

5. A folding table according to claim 4 further comprising a transverse bar joining together the first pair of legs, joinder of the legs being at the vertex of the obtuse angle thereof.

6. A folding table according to claim 5 further comprising a further transverse bar joining together the second pair of legs, joinder of the legs being at the vertex of the obtuse angle thereof.

7. A folding table according to claim 6 wherein in a completely folded position of the table, the upper portions of the first and second pair of legs are oriented parallel to one another while the lower portions of the first and second pair of legs are oriented away from one another.

* * * * *